US006886795B2

(12) United States Patent
Schultz

(10) Patent No.: US 6,886,795 B2
(45) Date of Patent: May 3, 2005

(54) ACCESSORY STORAGE DEVICE

(76) Inventor: James Schultz, 211 Sandy Point La., Lake Zurich, IL (US) 60047

( * ) Notice: Subject to any disclaimer, the term of this patent is extended or adjusted under 35 U.S.C. 154(b) by 324 days.

(21) Appl. No.: 10/407,293

(22) Filed: Apr. 4, 2003

(65) Prior Publication Data

US 2003/0189150 A1 Oct. 9, 2003

Related U.S. Application Data

(60) Provisional application No. 60/370,075, filed on Apr. 4, 2002.

(51) Int. Cl.[7] ..... A47G 1/10

(52) U.S. Cl. ..... 248/316.2; 248/316.1

(58) Field of Search ..... 248/316.1, 316.5, 248/231.51, 231.31, 316.2, 228.4, 228.2; 211/89.01, 70.5, 85.7

(56) References Cited

U.S. PATENT DOCUMENTS 5,826,908 A * 10/1998 McBride ..... 280/814

* cited by examiner

*Primary Examiner*—Leslie A. Braun
*Assistant Examiner*—Kofi Schulterbrandt
(74) *Attorney, Agent, or Firm*—Fitch, Even, Tabin & Flannery

(57) ABSTRACT

A storage device for accessories, such as wakeboards and the like on a boat, may be mounted to maximize space and secure objects for storage. The device includes displaceable levers, fixed arms, and an actuating assembly that provides a spring bias for displacing the levers towards the fixed arms to provide a clamping force against an item or accessory to be stored.

26 Claims, 9 Drawing Sheets

ACCESSORY STORAGE DEVICE

CROSS-REFERENCE TO RELATED APPLICATION

This application claims benefit to U.S. Provisional Application No. 60/370,075, filed Apr. 4, 2002.

FIELD OF THE INVENTION

The invention relates to a device for mounting and storing accessories and, more specifically, to a device for mounting and storing boards and the like.

BACKGROUND OF THE INVENTION

Currently, the design of boats, boat accessories, and space allotment on a boat is the subject of intense engineering. Each of these is examined from the standpoint of functions, aesthetics, and ergonomics. The use of the boat and its various accouterments are ideally designed so that the boat is easy to use and navigate, the compartments of the boat designed for human occupation are comfortable and pleasing and functional, and the compartments for storing accessories are simple to access while abstaining from hindering an occupants movement and while also maximizing the use of the boat's on-board space.

In comparison to other water sports, wakeboarding is a sport still in relative nascence. The sport is similar to waterskiing in that a person, the wakeboarder, is towed by a rope behind a powerboat. Instead of riding a relatively narrowly ski, however, a wakeboarder rides an appropriately titled wakeboard. A wakeboard is much wider than a waterski and typically much shorter. In addition, the boats used to tow wakeboarders have a feature not utilized with waterskiing, specifically, a tower. From the tower, a mount is located from which the wakeboarder's tow rope is attached. The mount, being located at a higher point than the wakeboarder's grip, therefore provides a lift to the wakeboarder which facilitates the performance of tricks and stunts by the wakeboarder.

Wakeboarding is considered by its participants to be an exciting, fresh, and trendsetting sport. Accordingly, the items that go along with wakeboarding reflect this attitude. For instance, boards are fancifully decorated in a manner similar to skateboarding, surfing, and other so-called "extreme sports." Therefore, a strong appeal to a wakeboarder is not only the function of a wakeboard's or a wakeboarding boat's design but also its aesthetic. Of course, the ergonomics, or simplicity of use, is also a factor.

Like in waterskiing, the wakeboard is usually carried on board the boat. In order to conserve space within the passenger compartment, it is preferred that any on-board wakeboards refrain from hindering the movement of occupants, and that the wakeboards are stored simply and securely, as well as being readily removed from storage for use.

Accordingly, there is a need for devices for on-board storage of board like accessories, such as wakeboards, that are functional and ergonomically and aesthetically pleasing.

SUMMARY OF THE INVENTION

In accordance with one aspect of the present invention, a storage apparatus is disclosed including a body defining at least one accessory receiver, at least one clamping member at the at least one accessory receiver, the clamping member having a first position to enable the at least one receiver to receive an item for storage and a second position to apply force to secure an item in the at least one receiver for storage, and an actuator that actuates movement of the at least one clamping member between the first and second position and having a spring biasing the clamping member to the first position.

The clamping member may be a lever and may be spring-biased towards the accessory receiver. The lever may have a pivot, and the actuating assembly may spring-bias the lever around its pivot for biasing the lever towards the accessory receiver for securing an accessory between the lever and the accessory receiver.

Each accessory receiver and the clamping member have opposing portions including a bumper and providing a space in which an accessory is secured.

The actuating assembly may include a shifter which the actuator may shift to provide the clamping member with its position. The clamping member may include a lever extending in a first direction from a pivot, the actuating assembly may spring-bias the lever around the lever's pivot when in the second position for biasing the lever towards the accessory receiver for securing an accessory between the lever and the accessory receiver, and the clamping member may include a lobe extending from a second direction from the pivot. The lobe may include a bore for receiving the shifter, the actuator assembly may include at least a first lever spring bias member, and the actuator may move the shifter such that the shifter forces the lever spring bias member against the lobe and provides the clamping member a rotational spring bias around the pivot.

The actuator may be a handle, and may include a releasable lock for retaining the actuator in an actuated position. The lock may include a displaceable pin lock which moves into contact with a lock portion of the device when the actuator is in the actuated position. The pin lock may be biased to a position for contacting the lock portion of the device. The pin lock may be released by displacing the pin lock from its biased position such that the handle may be returned to the release position. The device may also include a cover cap with a port through which the actuator extends, the lock portion of the device may be a wall on the cover cap, and the pin lock may include a flat portion for mating with the wall on the cover cap for retaining the actuator in the actuated position. The cover cap may mount the device to a boat, for example.

DESCRIPTION OF THE PREFERRED EMBODIMENTS

Figure 1:
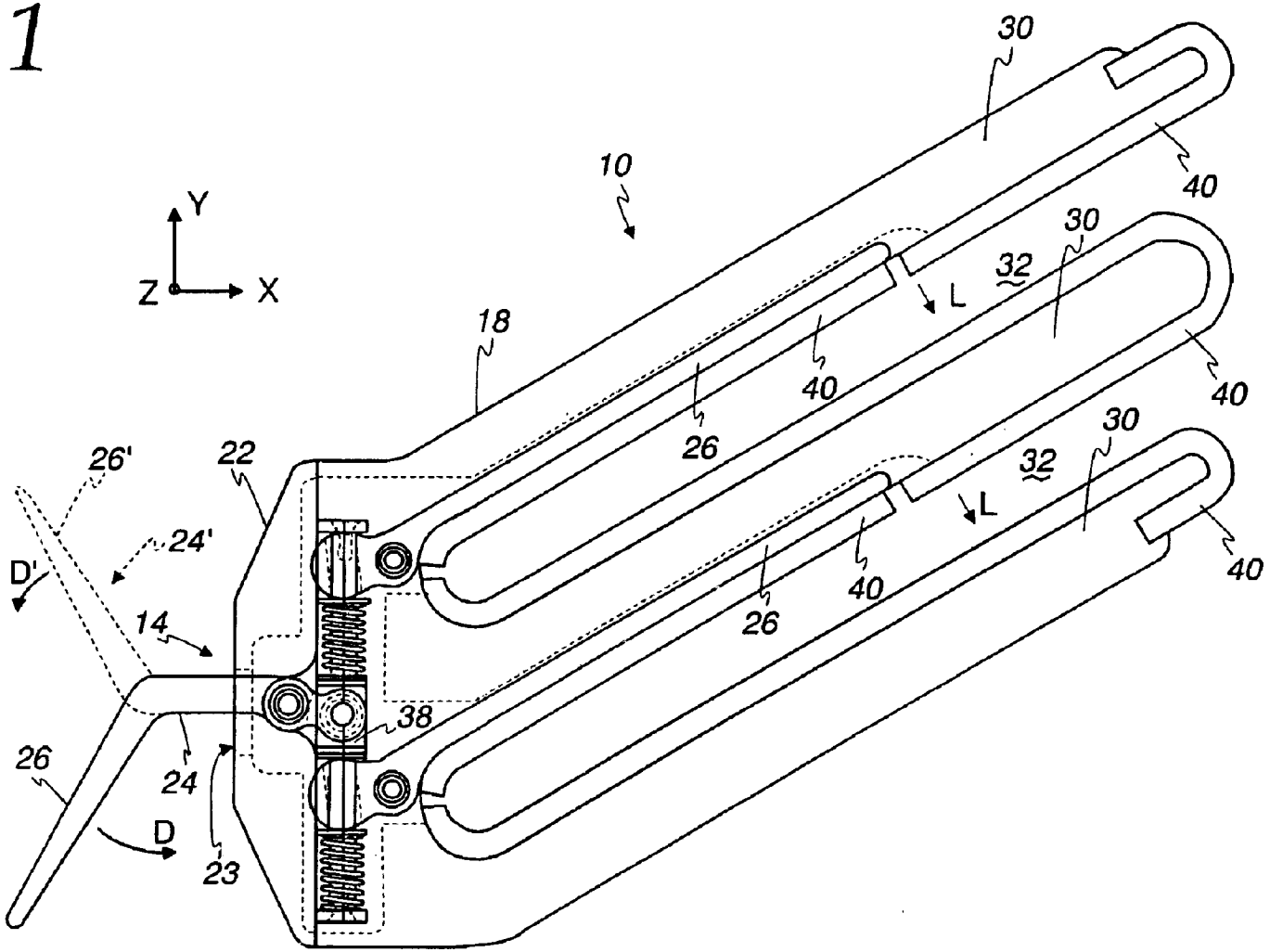
FIG. 1 is a side elevation view in partial phantom of a first embodiment of an accessory storage device embodying features of the present invention in a released position.

Referring initially to FIG. 1, there is illustrated a storage device 10 embodying features of the present invention. This device is designed to securely retain generally planar items such as skis, surfboards, and wakeboards. In addition, as will be clear from the following description, the device provides a spring-actuated clamping force which may define a closed loop making it possible to generally retain other objects with the device.

Figure 2:
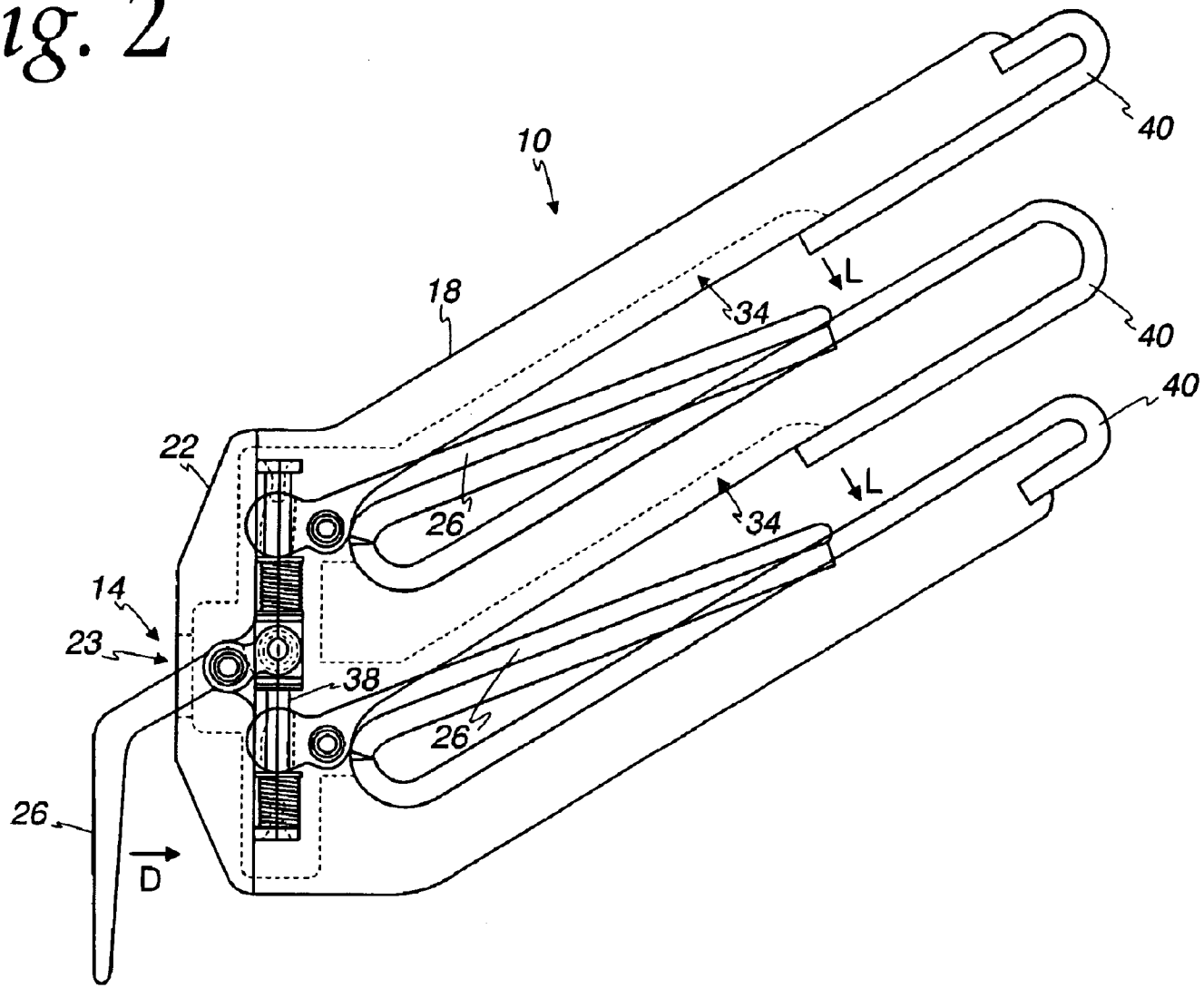
FIG. 2 is a side elevation view in partial phantom of the device of FIG. 1 in an actuated position without an accessory.

In FIG. 1, the device 10 is shown in a released position and includes generally an actuating assembly 14, a body 18, and a cover cap 22. The actuating assembly 14 has an actuating handle 24. The cover cap 22 has a port 23 through which the handle 24 extends. FIG. 2 depicts the actuating assembly 14 in a clamping or actuated position and, as compared to FIG. 1, the handle 24 is in a second, actuated position. Viewing FIGS. 1 and 2 together, the device 10 can be seen as being actuated by the depression of a grip 26 of the handle 24 in a direction toward the body 18 as depicted by reference arrow D.

As depicted in FIG. 1, the grip 26 of the handle 24 is angled below horizontal. An alternative, the grip 26 may be angled above horizontal, such as is depicted in phantom as handle 24'. In such case, the device 10 is actuated by shifting a grip 26' in a direction as depicted by reference arrow D'.

Figure 3:
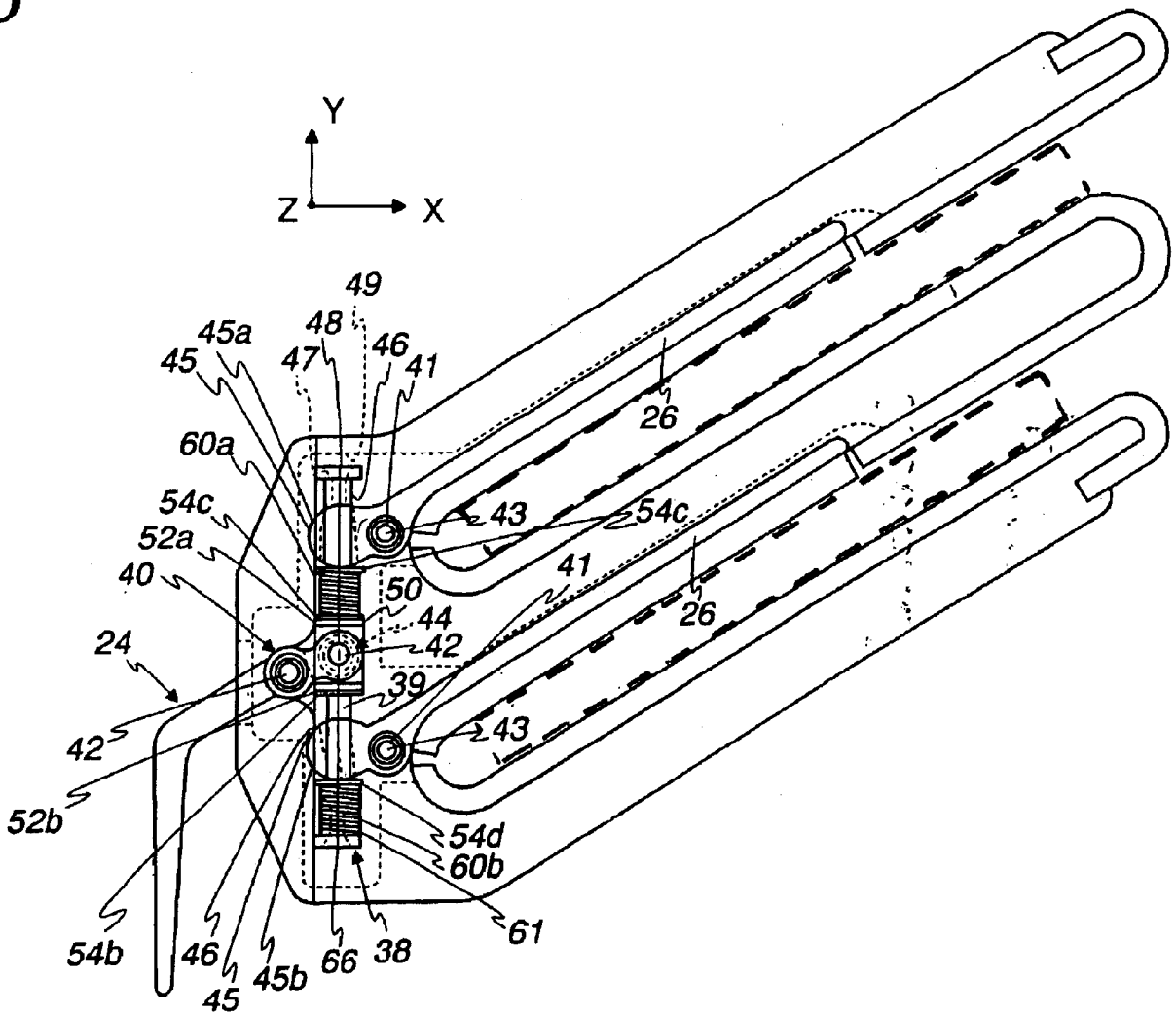
FIG. 3 is a side elevation view in partial phantom of the device of FIG. 1 in an actuated position as it would be with at least one accessory mounted therein.

The actuating assembly 14 further includes clamping members or, preferably, actuating levers 26. As the handle 24 is displaced to an actuated position, the levers 26 of the device 10 move in the direction of reference arrow L to a displaced position as shown in FIG. 2. It should be noted that FIG. 2 shows the displacement of the levers 26 in the absence of an item to be stored by the device 10. When an item is stored by the device 10, the levers 26 may be either minimally displaced or remain virtually stationary despite the actuated position of the handle 24, as is depicted in FIG. 3. The actuation of the handle 24 creates a spring bias force against the levers 26 such that the levers 26 are displaced from their released position (FIG. 1) to their actuated position (FIGS. 2 and 3). In the presence of an item to be clamped in the device 10, the spring bias force is increased by the limiting effect of the movement of the levers 26, which increases the clamping ability (i.e., the clamping force) applied by the levers 26 to one or more items in the device.

The body 18 is formed of a material suitable for damp environments, such as aluminum. The body 18 includes a plurality of accessory receivers depicted here in the form of three arms 30 defining two accessory receiving slots 32. The arms 30 angle upward so that items to be stored may be placed in the slots 32 and may rest in the slots 32 by their own weight, and so that the extent to which the device 10 protrudes, such as from a boat, is reduced. When the clamping members, such as the levers 26, move to an actuated position, they are displaced into the receiving slots 32.

Figure 8:
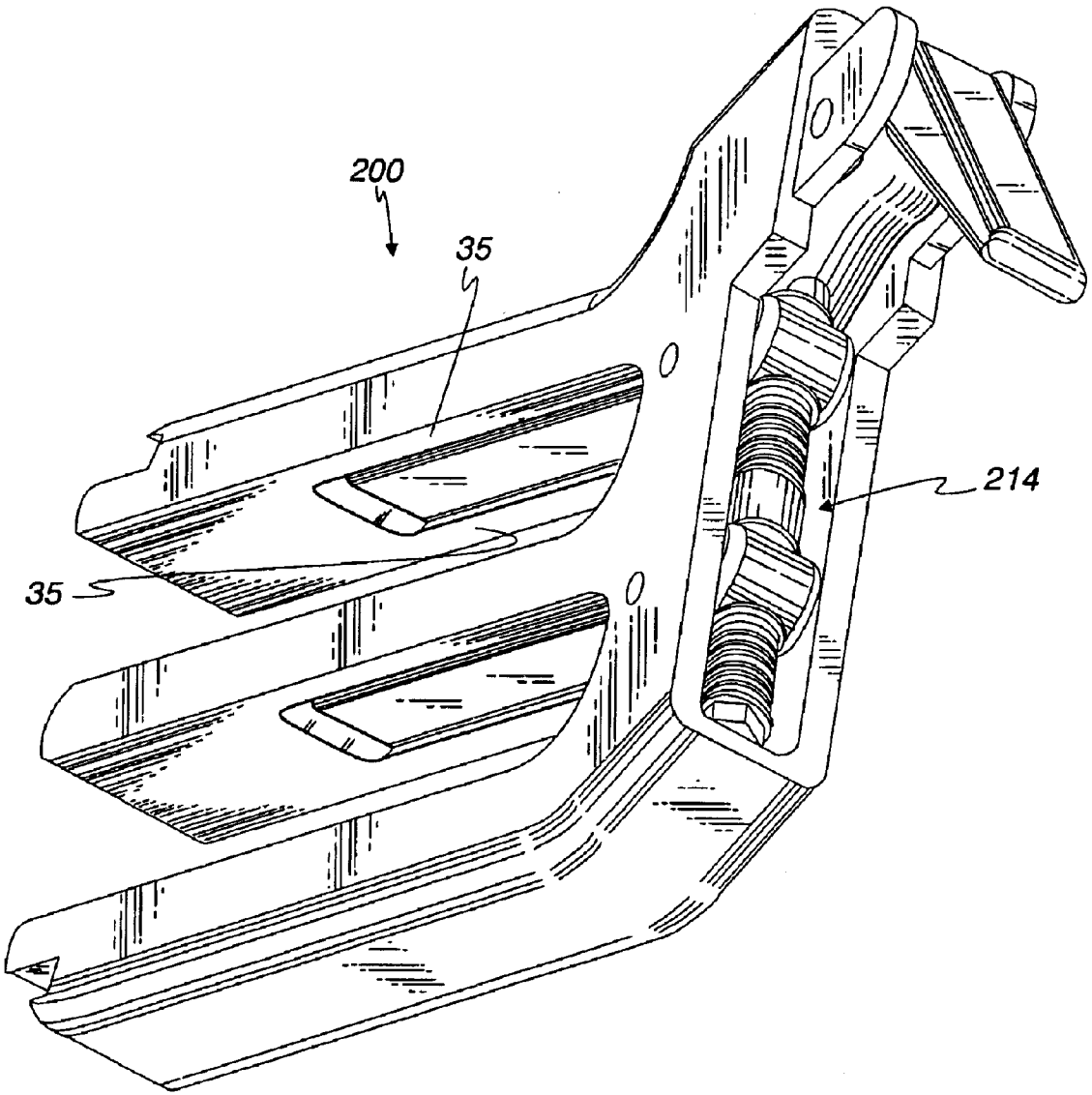
FIG. 8 is another perspective view of the device of FIG. 6 with the cover to display the actuating assembly.

Each arm 30 defines a recess 34 designed to receive at least a portion of one of the levers 26 when in a released position. With reference to the X-Y-Z coordinate system provided in FIG. 1, the levers 26 may have a width in the Z direction equal to, larger than, or smaller than the width of the arms 30 in the Z direction. In cases where the levers 26 have a smaller width than the arms 30, the recess 34 preferably has longitudinal side walls 35 (see FIG. 8) alongside the lateral portions of the levers 26. In the other cases, the lever extends parallel to the longitudinal sides of the arms or beyond.

As the accessory or item is inserted into the device 10 for storage, it necessarily will contact surfaces of the device 10. In order to minimize damage to the item when being inserted (particularly if done haphazardly so that the item contacts the arms 30 in a number of points), the interior of the slots 32, i.e., the surface of the levers 26 and arms 30, and the ends of the arms 30, are covered with a layer of cushioning material 40, such as rubber or any other material suitable for damping impact shock and appropriate for damp environments.

In FIGS. 1–3, the dashed line indicates generally interior cavity portions of the body 18 and the cap 22. The actuating assembly 14 is located, secured, and operates at least in part within the interior cavity portions.

As illustrated in FIGS. 1–3, the actuator assembly 14 has the two levers 26 and the single handle 24. It is noted here that it is contemplated that a device in accordance with the present invention may have more than two slots and thus more than two levers and/or handles. The actuator assembly 14 includes a shifter 38 that is shifted, e.g., in the Y direction, by movement of the handle 24. The handle 24 has a pair of pivots, a body pivot 40 about a pin 42 connected to the body 18, and a shifter pivot 44 about a pin 42 connected to the shifter 38. Each lever 26 has a body pivot 41 about a pin 43 connected to the body 18 and an end lobe 45, and defines a bore 46 in the lobe 45 through which the shifter 38 passes.

The shifter 38 includes an elongated shaft 39 and a central bracket 50 attached to the shaft 39 and to which the handle 24 attaches at the shifter pivot 44. The central bracket 50 includes top and bottom walls **52*a*, 52*b* extending generally transverse to the shaft 39 of the shifter 38. Against the top and bottom walls 52 are friction reducers, such as nylon washers 54*a*, 54*b* with a central bore (not shown) through which the shaft 39 extends. The washer 54*a* on the top wall 52*a* abuts a coil spring 60*a*, which in turn abuts a friction reducer, such as a nylon washer 54*c*, through which the shaft 39 extends. The nylon washer 54*c* abuts the lobe 45*a* of one of the levers 26*a*. In the present form, the lobe 45*a* of the lever 26***a* abuts a stop 47, such as a metal washer 47 secured to the shaft 39 by a screw 48 at the end of the shaft 39. Alternatively and in addition, the lobe 45*a* of the lever 26*a* may further abut a friction reducer (not shown), which in turn may abut a coil spring (not shown) secured against the inner cavity surface of the body 18 as at 49 thereby providing a spring bias to the released position.

The washer 54*b* on the bottom wall 52*b* of the central bracket 50 abuts the lobe 45*b* of a second one of the levers 26, which, in turn, abuts a nylon washer 54*d*. The nylon washer 54*d* abuts a coil spring 60*b*, which is held at its lower end 61 to the end of the shaft 39, which has a stop 64, such as a steel washer secured to the shifter by an axially located screw 66.

In operation, when the grip 25 of the handle 24 is displaced in the direction of arrow D, the handle 24 rotates around its body pivot 40 thereby causing its shifter pivot 42 to displace in the vertical (i.e., positive Y) direction. This displacement forces the shifter 38 to also displace in the vertical direction. As the shifter 38 displaces in the vertical direction, the bracket 50 biases the coil spring 60*a* against the lobe 45*a* of the lever 26*a*, thereby also biasing the lobe 45*a* upward and rotationally biasing the lever 26*a* around its body pivot 40 so that the lever 26*a* is biased into the receiving slot 32*a*. Simultaneously, the movement of the shifter 38 in a vertical direction draws its lower end 61 in a vertical direction. The coil spring 60*b* biases against the lobe 45*b* of the lever 26*b* to bias the lobe 45*b* upward and to bias rotationally the lever 26*b* around its body pivot 40 so that the second lever 26*b* also is biased into the receiving slot 32*b*.

Figure 4:
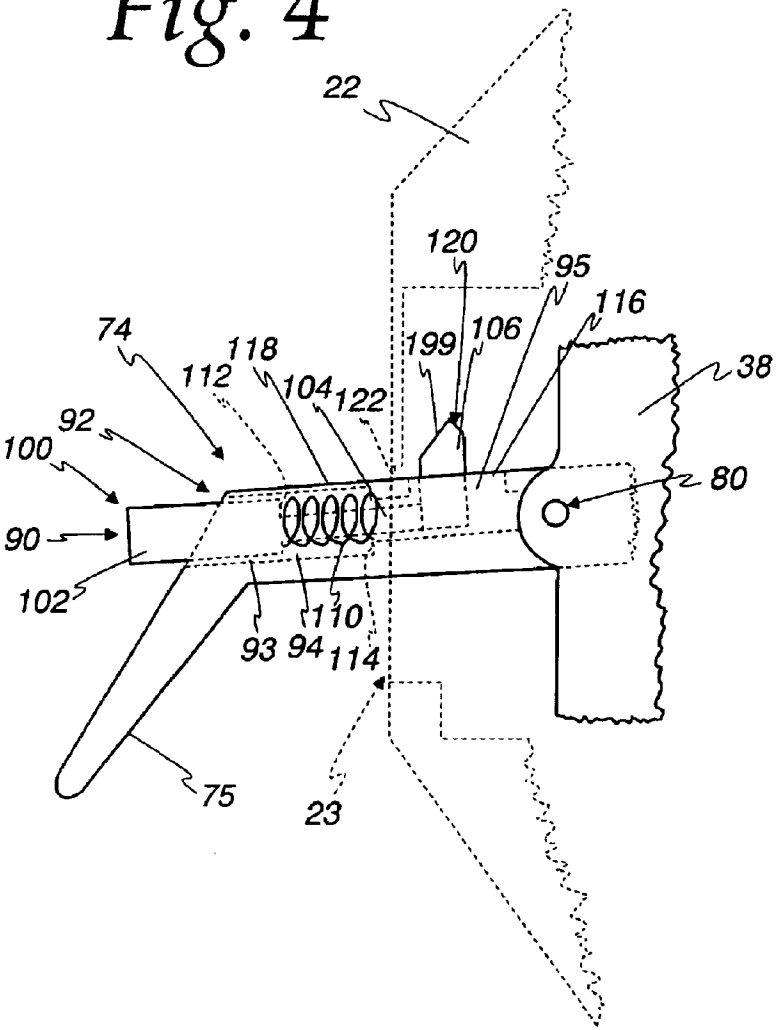
FIG. 4 is a side elevation view in partial phantom of an actuating device embodying features of the present invention.
Figure 6:
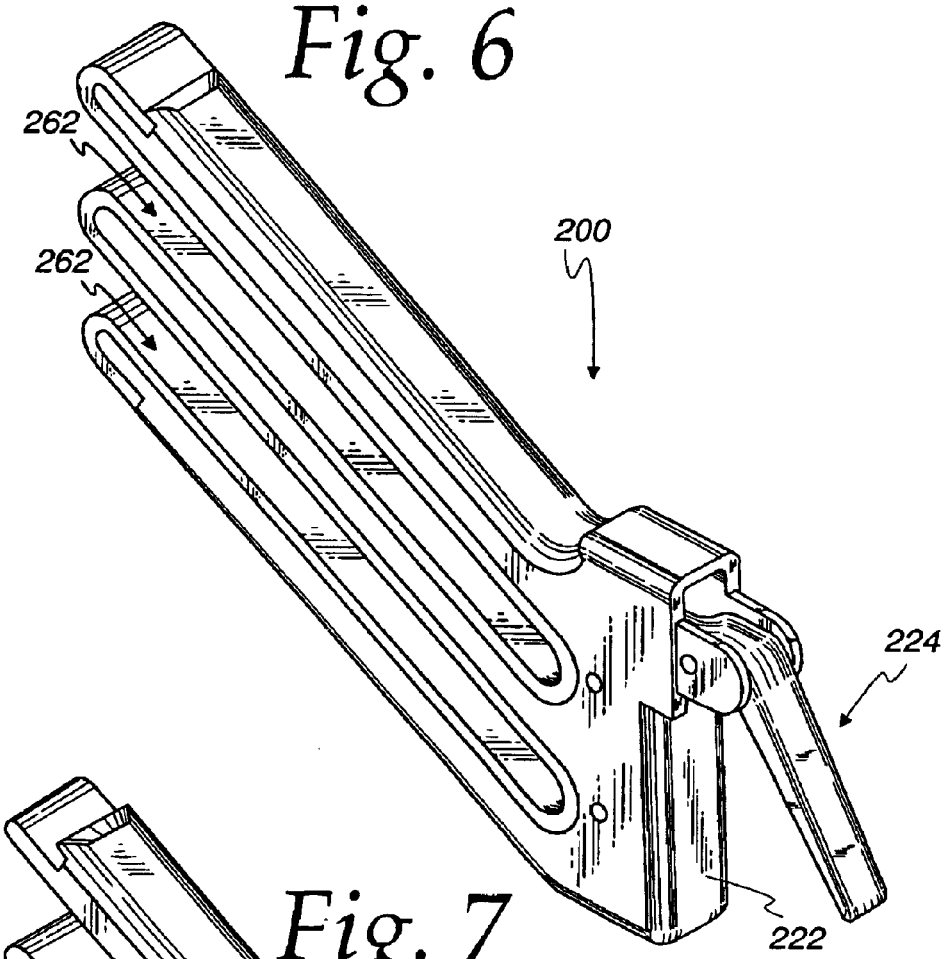
FIG. 6 is a perspective view of another embodiment of an accessory device embodying features of the present invention.
Figure 7:
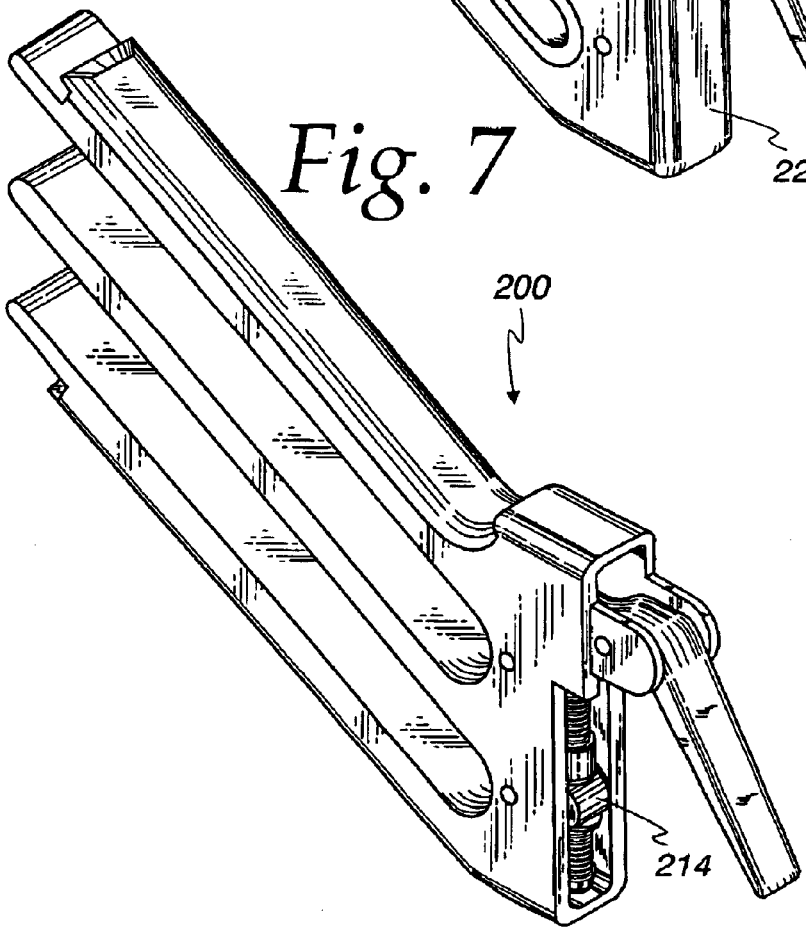
FIG. 7 is a perspective view of the device of FIG. 6 with a cover removed to display an actuating assembly.

Referring now to FIG. 4, a form of an actuator in the form of a handle 74 is depicted with a grip 75 and a body pivot 80. The actuation of the actuator assembly 14 as described above is preferably biased to a release position for the insertion or removal of accessories, such as wakeboards, from the device. In operation, the actuation assembly 14 is designed to overcome this bias to secure the items; however, it will not maintain the secure position unless locked in that position, but the assembly 14 must be held against the bias. Accordingly, a lock mechanism 90 may be provided as, for example, the one depicted in FIG. 4.

The handle 74 defines a central bore 92 with a first compartment 93, a second compartment 94, and a third compartment 95. The first compartment 93 houses a cylindrical first section 102 of a lock pin 100, the second compartment 94 houses a cylindrical second section 104 of the lock pin 100, and the third compartment 95 houses a third section 106 of the lock pin 100. In assembling the lock mechanism 90, the second section 104 of the lock pin 100 is joined with a bias member, preferably a coil spring 110 into which the second section 104 extends. Preferably, the first and second sections 102 and 104 of the lock pin 100 are formed integral, and with the first section 102 being of a larger diameter than the second section 104. The diametral size difference at the juncture forms a shoulder 112 against which one end of the coil spring 110 abuts. The first compartment 93 is demarcated from the second compartment 94 by a shoulder 114 against which the other end of the coil spring 110 abuts.

After inserting the second section 104 into the coil spring 110, the first and second sections 102, 104 and the coil spring 110 are inserted into the first and second compartments 93 and 94 such that a portion of the second section 102 extends into the third compartment 95. The second section 104 is then attached to the third section 106 such that the first and second sections 102, 104 are secured in the bore 92. The third section 106 rises through a port 116 adjoining the central bore 92 and opening to the top side 118 of the handle 24.

The third portion includes a first angled surface 119 and a second angled surface 120. When the handle 24 is moved to the actuated, displaced position, the flat 120 abuts a lock portion in the form of wall 122 in the port 23 of the cover cap 22 such that the handle 24 is held or locked in the actuated position. The spring 110 biases the third portion outward of the cavity, thereby causing the first angled surface 119 to cam over the edge of the wall 122 and, eventually, the second angled surface 120 to release from the cavity to engage the wall 122. In this position, the flat 120 and the wall 122 mate flat and flush against each other. In order to release the handle 24, the handle 24 is slightly depressed so as to separate the flat 120 from the wall 122, and the lock pin 100 is depressed to compress the coil spring 110 and shift the third section 106 inward so that the third section 106 clears the wall 122 and shifts into the cavity through the port 23.

Figure 5:
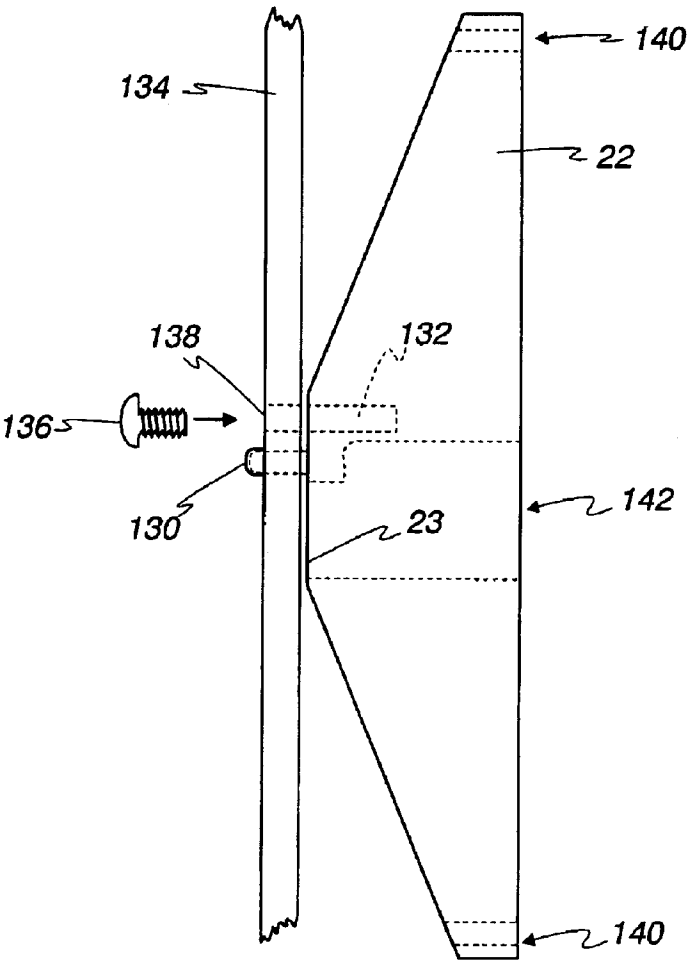
FIG. 5 is a perspective view of a cover cap embodying features of the present invention.

With reference to FIG. 5, once assembled but prior to receiving accessories, the device 10 is secured to a structure, such as a boat, for use. For example, in order to minimize any impedance to occupants of a boat, the device 10 is secured so that it is pointed outward from the boat, as are the accessories mounted thereon. Accordingly, the cover cap 22 includes a pair of posts 130 and a threaded bore 132. The posts 130 pass through openings defined by a mounting structure 134 that is a part of the boat. A threaded fastener 136 is received by a bore 138 in the structure 134 and is secured in the threaded bore 132, thereby securing the device 10 to the boat by securing the cover cap 22 to the boat. The cover cap 22 includes threaded bores 140 for securing to the body 18, and includes the interior cavity 142 for receiving a handle 24.

Referring now to FIGS. 6–9, another form of a device 200 embodying features of the present invention is depicted. The device 200 includes a handle 224 located at the uppermost portion of a cover cap 222 and an actuating mechanism 214. The actuating mechanism, from bottom to top, includes a nut 230 threaded onto a shifter shaft 232 that is vertically aligned and generally runs the height of the actuating mechanism 214. The nut 230 holds a washer 234 against a coil spring 236 that abuts a friction reducing washer 238. The washer 238 abuts a lobe 240 of a lever 226*a*, and the other side of the lobe 240 abuts a friction reducing washer 242. The washer 242 is against or in indirect communication with a spring 244. The spring 244 abuts a friction reducing washer 246 that abuts a lobe 250 of a second lever 226*b*. The other side of the lobe 250 abuts with a lobe 252 on the handle 224 with a friction reducing washer 254 in between the two lobes 250, 252. As can be seen, the shifter shaft 232 passes through each of the pieces of the actuating mechanism 214 and is secured at the top end by a second nut 231 with a friction reducing washer 260 against the lobe 252.

Figure 9:
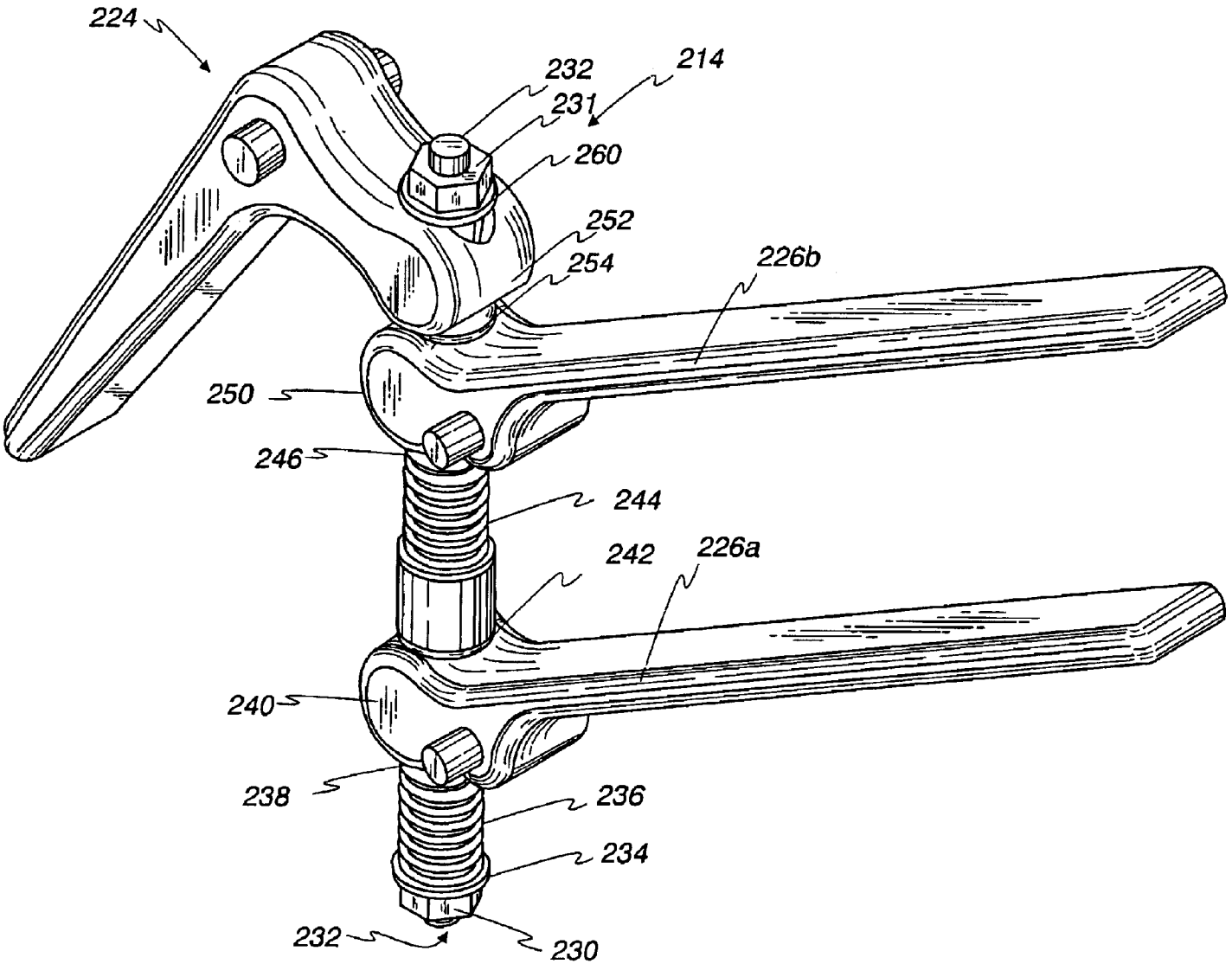
FIG. 9 is a perspective view of the actuating assembly of the device of FIG. 6.

The actuating assembly of FIG. 9 is a self-locking mechanism where the lobe 252 of the handle 224 nests and cooperates with the lobe 250 of the lever 226*b*. More specifically, the downward rotation of the handle 224 enables the springs 236 and 244 to bias the levers 226*a*, 226*b* toward the receiving slots 262. Beyond a certain rotation, the complementary cooperation of the lobes 252 and 250 causes the lobes 250 and 252 to diminish the biasing force towards the unreleased position, and then to lock the handle 224. That is, the curvature of the lobes 250 and 252 enables them to nestle against one another. To release the lock, the handle 224 is lifted to release gripping or clamping provided by the levers 226*a*, 226*b*.

Figure 10:
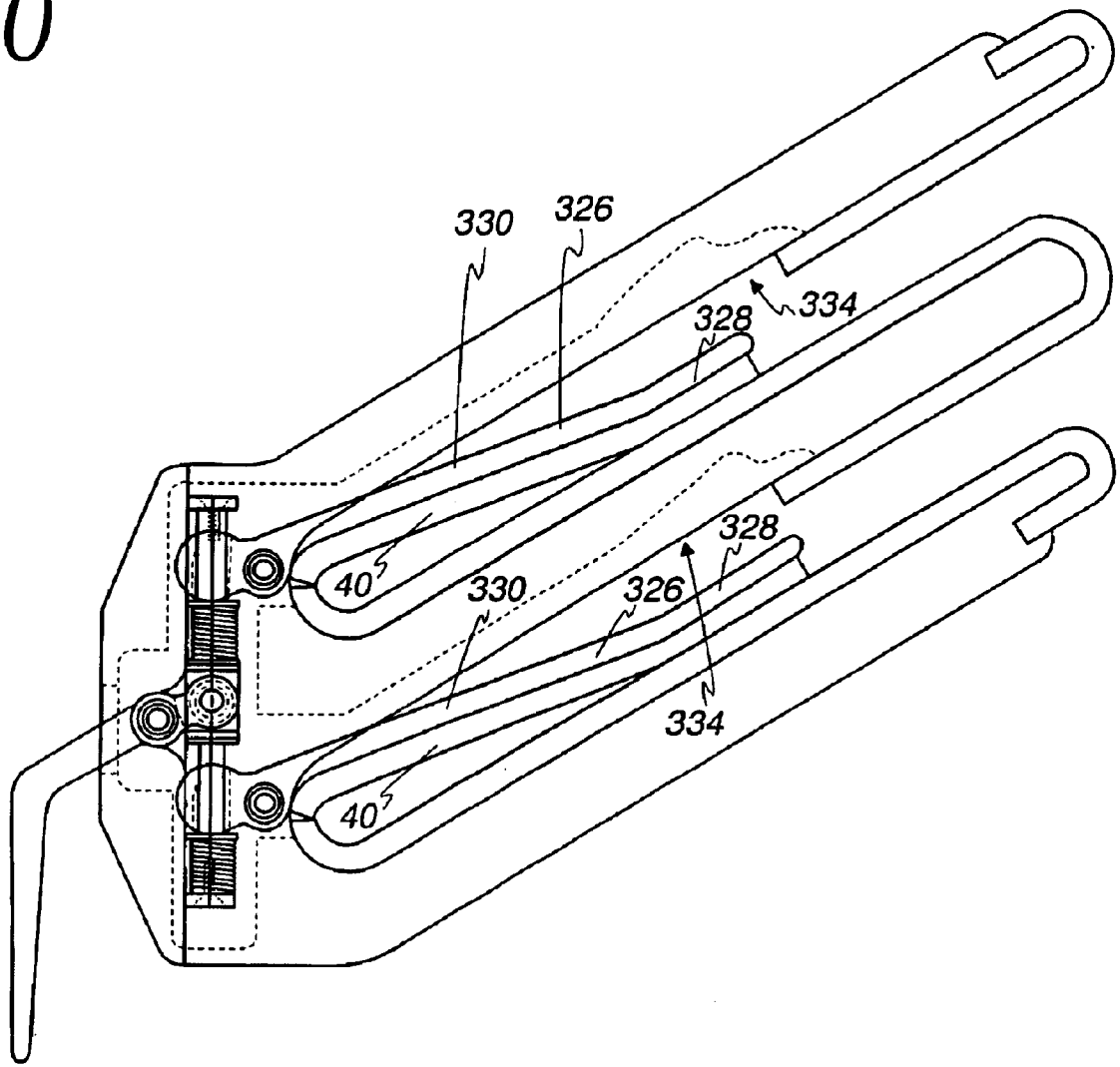
FIG. 10 is a side elevation view in partial phantom depicting an alternative embodiment the present invention.

An alternative embodiment of the levers 326 is depicted in FIG. 10 and corresponding to the levers 26 of FIGS. 1–3. As can be seen, the levers 326 each may have a first portion 330 extending from the body pivot 41 of the lever 26 and a oblique portion 328 at an angle from the first portion 330. The configuration of the levers 326 provides an area of contact between bumper 40 portions, as at 350. A recess 334 corresponding to recess 34 may be provided. However, as the lever 326 has a non-linear shape, the recess 334 has a corresponding shape.

Figure 11:
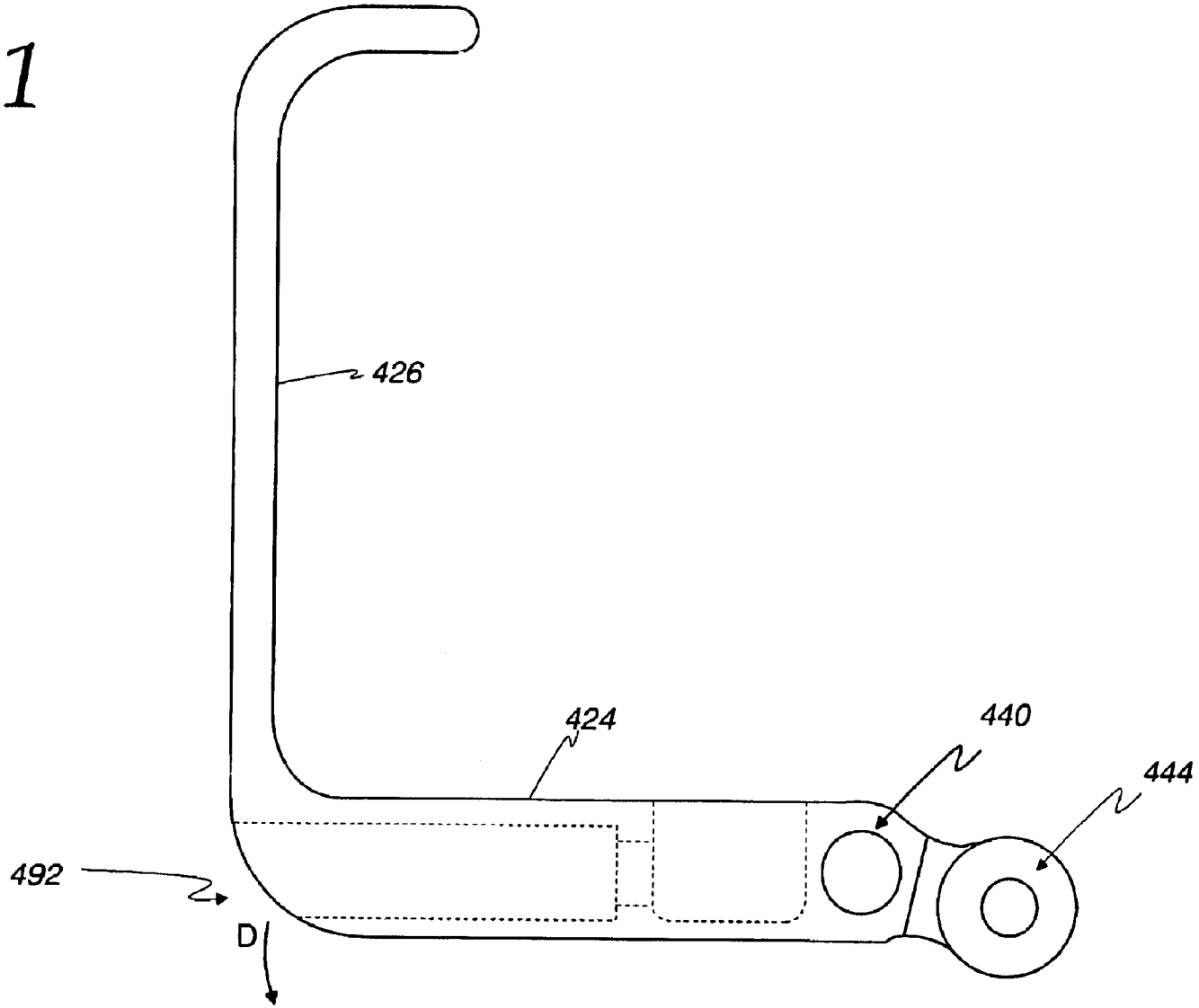
FIG. 11 is a side elevation view of an alternative embodiment of an actuator of a form of the present invention.

An alternative embodiment handle 424 to the handles 24 and 24' of FIG. 1 is depicted in FIG. 11. The handle 424 includes a grip 426 corresponding to grips 26 and 26', a body pivot 440 corresponding to body pivot 40, and shifter pivot 444 corresponding to shifter pivot 44. As depicted, the handle 424 shows a central bore 492 corresponding to the central bore 92 of FIG. 4. The handle 424 is rotated in the direction of reference arrow D in order to actuate the device to an actuated position in the above-discussed manner.

Referring to FIGS. 2 and 3, the spring-bias attribute of the actuating assembly 14 has numerous benefits. For example, it should be noted that FIG. 2 depicts the levers 26 in an actuated position where the levers 26 are displaced through the receiving slots 32 to the point of contacting the opposing arm 30. This displacement defines a space 280 within which other items may be retained, such as an item received in the slot 32 with a large enough size to be contacted by the bumpers 40, or any type of closed-loop item that may be hung from the arm 30 (such as the looped heel portion of a flipper). Also, it should be noted that the levers 26 may be adjusted from the actuated position. That is, the levers 26 are not mechanically forced to displace a prescribed distance. This allows the levers 26 to clamp to items located in the receiving slot 32 without damaging the items through excessive clamping.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. A storage apparatus comprising:

a body defining at least one receiver;

at least one clamping member cooperating with the at least one receiver and being moveable between a first position so the at least one receiver can receive an item for storage and a second position to apply force to secure an item in the at least one receiver for storage; and an actuator having at least one spring capable of biasing the at least one clamping member, the actuator being selectively operable to move the at least one damping member toward the second position and convert the biasing of the at least one spring to a clamping force.

2. The storage apparatus of claim 1 wherein the at least one clamping member is pivotally attached to the body and the biasing of the at least one spring is capable of pivoting the at least one clamping member toward the second position and the actuator being selectively operable to move the at least one clamping member toward the second position and convert the biasing of the at least one spring to a clamping force.

3. The storage apparatus of claim 2 wherein the actuator further comprises a shifter cooperating with the at least spring to selectively convert the biasing of the at least one spring to a clamping force.

4. The storage apparatus of claim 3 wherein the actuator further comprises a lever to selectively shift the shifter to selectively convert the biasing of the at least one spring to a clamping force.

5. The storage apparatus of claim 4 wherein the at least one clamping member has at least one arcuate surface to cooperate with actuator to facilitate movement of the at least one damping member between the first and second positions.

6. The storage apparatus of claim 5 wherein the at least one clamping member has an enlarged end which includes the at least one arcuate surface to cooperate with actuator to facilitate movement of the at least one clamping member between the first and second positions.

7. The storage apparatus of claim 4 wherein at least a portion of the at least one receiver includes a non-damaging surface to protect items stored therein.

8. The storage apparatus of claim 7 wherein the non-damaging surface comprises a resilient liner layer.

9. The storage apparatus of claim 1 wherein the actuator further comprises a selectively lock having a release mode to permit an time to be positioned in the receiver and a lock mode to maintain the at least one damping member toward the second position to maintain a clamping force on an item in the receiver.

10. The storage apparatus of claim 9 wherein the lock further comprises a displaceable pin which moves into contact with a portion of the body when the lock is in the lock mode.

11. The storage apparatus of claim 10 wherein the lock further comprises at least one spring for biasing the displaceable pin into contact with a portion of the body.

12. The storage apparatus of claim 11 wherein the lock further comprises a driver to selectively actuated to move the displaceable pin out of contact with a portion of the body.

13. A storage apparatus comprising:

a body defining at least one accessory receiver;

at least one clamping member at the at least one accessory receiver, the clamping member having a first position to enable the at least one receiver to receive an item for storage and a second position to apply force to secure an item in the at least one receiver for storage; and an actuator that actuates movement of the at least one clamping member between the first and second position, and having a spring capable of biasing the clamping member.

14. The storage device of claim 13 wherein the clamping member is a lever that may be spring biased towards the accessory receiver.

15. The storage device of claim 14 wherein the lever has a pivot, and wherein the actuating assembly spring biases the lever around its pivot for biasing the lever towards the accessory receiver for securing an accessory between the lever and the accessory receiver.

16. The storage device of claim 13 wherein each accessory receiver and the damping member have opposing portions including a bumper and providing a space in which an accessory is secured.

17. The storage device of claim 13 wherein the actuating assembly further includes a shifter which the actuator may shift to provide the clamping member with its position.

18. The storage device of claim 17 wherein the clamping member includes a lever extending in a first direction from a pivot, the actuating assembly spring biases the lever around its pivot when in the second position for biasing the lever towards the accessory receiver for securing an accessory between the lever and the accessory receiver, and the clamping member includes a lobe extending from a second direction from the pivot.

19. The storage device of claim 18 wherein the lobe includes a bore for receiving the shifter, the actuator assembly includes at least a first lever spring bias member, and the actuator may move the shifter such that the shifter forces the lever spring bias member against the lobe and provides the clamping member a rotational spring bias around the pivot.

20. The storage device of claim 13 wherein the actuator is a handle.

21. The storage device of claim 20 wherein the handle includes a releasable lock for retaining the actuator in an actuated position.

22. The storage device of claim 21 wherein the lock includes a displaceable pin lock which moves into contact with a lock portion of the device when the actuator is in the actuated position.

23. The storage device of claim 22 wherein the pin lock is biased to a position for contacting the lock portion of the device.

24. The storage device of claim 23 wherein the pin lock is released by displacing the pin lock from its biased position such that the handle may be returned to the release position.

25. The storage device of claim 23 further including a cover cap including a port through which the actuator extends, the lock portion of the device is a wall on the cover cap, and the pin lock includes a flat portion for mating with the wall on the cover cap for retaining the actuator in the actuated position.

26. The storage device of claim 13 further including a cover cap for mounting the device to a boat.

* * * * *

UNITED STATES PATENT AND TRADEMARK OFFICE

CERTIFICATE OF CORRECTION

PATENT NO. : 6,886,795 B2
DATED : May 3, 2005
INVENTOR(S) : Schultz, James

It is certified that error appears in the above-identified patent and that said Letters Patent is hereby corrected as shown below:

Column 8,
Lines 3, 25 and 42, change “damping” to -- clamping --.
Lines 15-16, after “least” insert -- one --.
Lines 24 and 30, after “with” insert -- the --.
Line 40, change “selectively” to -- selective --.
Line 41, change “time” to -- item --.

Column 9,
Line 10, change “damping” to -- clamping --.

Signed and Sealed this

Sixteenth Day of August, 2005

JON W. DUDAS
*Director of the United States Patent and Trademark Office*